United States Patent [19]

Torressen

[11] 3,961,984

[45] June 8, 1976

[54] SPACE SAVER DISHWASHER

[75] Inventor: Albert F. Torressen, Bronx, N.Y.

[73] Assignee: Lawrence Peska Associates, Inc., New York, N.Y. ; a part interest

[22] Filed: Jan. 30, 1975

[21] Appl. No.: 545,330

[52] U.S. Cl. ..... 134/100; 134/115 R; 134/179; 134/200

[51] Int. Cl.[2] ..... B08B 3/02

[58] Field of Search ..... 134/100, 101, 115 R, 134/115 G, 179, 175–177, 200

[56] References Cited

UNITED STATES PATENTS

| | | | |
|---|---|---|---|
| 1,590,914 | 6/1926 | Schramm | 134/177 |
| 2,236,262 | 3/1941 | Ehret | 134/175 X |
| 2,664,904 | 1/1954 | Stokes et al. | 134/179 |
| 3,384,099 | 5/1968 | Baumann | 134/115 R |
| 3,496,949 | 2/1970 | Mercer | 134/179 |

*Primary Examiner*—Robert L. Bleutge
*Attorney, Agent, or Firm*—Jack D. Slobod

[57] ABSTRACT

A compact dishwasher which is particularly adapted for placement in a sink or sink/tub combination and which connects directly to a faucet.

2 Claims, 3 Drawing Figures

SPACE SAVER DISHWASHER

BACKGROUND OF THE INVENTION

The invention relates to dishwashing apparatus which is particularly suitable for mounting in a sink. The prior art includes apparatus such as that shown in Baumann, U.S. Pat. No. 3,384,099 issued May 21, 1968. The apparatus therein has a general similarity of the apparatus of the present invention. It relies however on the use of a volute to direct a stream of water into a rotating blade. This causes the water to be directed against the articles to be washed. Such operation has not been found to be satisfactory for many applications.

Accordingly, it is a primary object of the invention to provide apparatus which will thoroughly wash eating utensils and dishes.

Still another object of the invention is to provide apparatus which is simple and inexpensive to manufacture.

SUMMARY OF THE INVENTION

It has now been found that these and other objects of the invention may be satisfied by apparatus which includes a housing in a conduit for water extending into the housing. A blade is carried for rotation about an axis within the housing which has a fluid passage extending from the axis thereof to the interior of the blade. The passage communicates with the conduit and with a plurality of holes disposed along the surface of the blade. Means are provided for rotating said blade.

Normally the means for rotating the blade comprises a plurality of the holes arrayed in a manner so that a reaction force urges the blade to rotate about the axis thereof. The blade may be mounted with the axis thereof generally vertical and proximate to the bottom of the housing. The conduit may include a collar and the blade may include a shaft cooperatively dimensioned for cooperation with the collar. The shaft and collar together function to conduct fluid from the conduit to the passage in the blade. The conduit may be equipped with an opening for receiving a soap.

BRIEF DESCRIPTION OF THE DRAWING

The invention will be better understood by reference to the accompanying drawing in which.

DESCRIPTION OF THE PREFERRED EMBODIMENT

Figure 1:
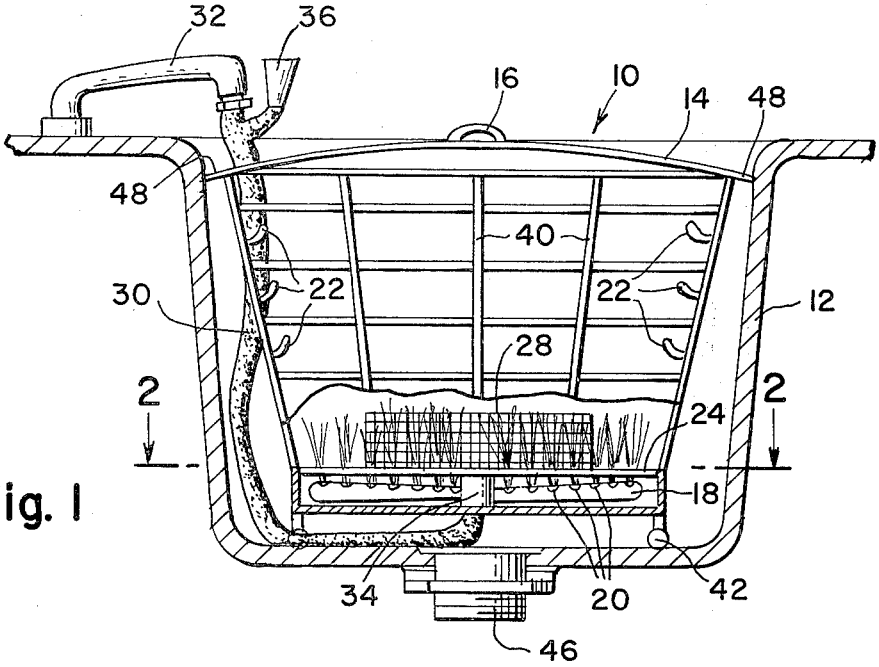
FIG. 1 is a sectional view taken through a vertical plan of the apparatus in accordance with the invention.
Figure 2:
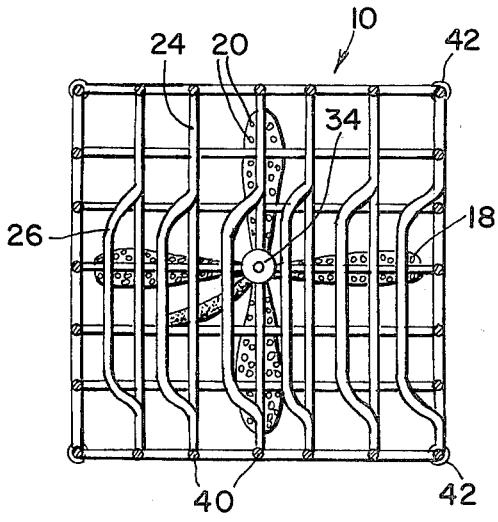
FIG. 2 is a partial section taken through the line 2—2 of FIG. 1.
Figure 3:
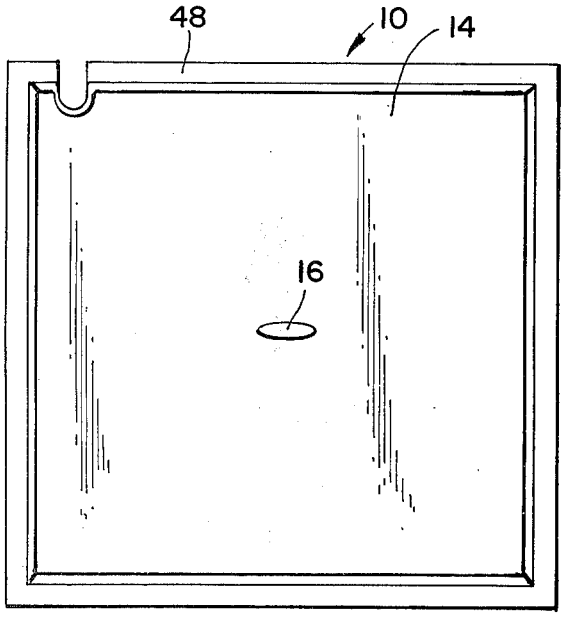
FIG. 3 is a plan view of still another portion of the apparatus shown in FIG. 1.

Referring now to FIGS. 1 through 3 there is shown a dishwasher 10 in accordance with one embodiment of the invention. The dishwasher 10 includes a housing 12 and a cover 14. The latter is provided with a handle 16. It will be understood that the housing 12 may be an integral part of the assembly 10 or may be merely a household sink of various shapes and sizes. Ordinarily the deeper variety are most suitable, because of the additional capacity. Carried for rotation about a vertical axis is a blade or propeller 18 which has a passageway (not shown) extending from the axis thereof to a plurality of holes 20 disposed along the surface thereof. Ordinarily the holes will be disposed in a manner which will impinge upon dishes and utensils, which are carried on hooks 22, on grid 24 by means of holders 26, and in basket 28. In addition the position of the holes 20 is chosen to cause a rotation of the blade 18. Accordingly, the water will impact upon the articles to be cleaned not only because of direction from the holes 20 but also be redirected against the articles by means of the rotating blade. A conduit 30 connects to a faucet 32 at one end and at the other end to a collar 34 which supports the blade 18 for rotation and also provides full communication to the passage of the blade therein. An opening 36 extends from the side of the conduit 30 for allowing admission of soap, which may be liquid, into the conduit. It will be understood that in some forms of the invention a checkvalve (not shown) may be provided to allow soap to enter when there is no pressure in the conduit 30 and which prevents the passage of water out of the opening 36.

A vertical grid 40 extends circumferencially about the grid 24 and is supported by legs 42 within the housing or sink 12. The sink 12 will be provided with a drain 46 in the customary manner and it is intended during operation that the drain will be open.

In operation the cover will be removed, dishes will be positioned on the hooks 22 and against the holders 26 and utensils will be positioned within the basket 28. Thereafter the cover which is provided with a peripheral seal 48 for engagement with the sink 12 is positioned over the vertical grid 40 and soap is positioned within the opening 36. Then the water is turned on at the faucet 32 and is left on for some time interval which is selected based on degree of cleaning which is necessary.

Having thus described my invention, I claim:

1. Apparatus for washing dishes in a sink comprising: a rack for placement in said sink, said rack having a bottom portion configured for standing on an interior bottom wall of the bowl of said sink and a top portion configured for holding dishes; a generally horizontal rotor rotatably carried by said bottom portion of said rack, said rotor having a central inlet port and upwardly facing water nozzles in fluid communication with said inlet port for spraying water upward onto said dishes, said nozzles being oriented for the production of a rotary reaction force upon said rotor; a conduit having means at one end for coupling to a faucet of said sink, the other end of said conduit coupled to said rotor inlet port; a cover for mounting over the top portion of said rack, said cover being configured for peripheral sealing engagement with the sidewalls of said sink; and an aperture in said cover for passage of said conduit therethrough.

2. The apparatus as described in claim 1 wherein said conduit includes an auxiliary opening for receiving soap.

* * * * *